US005457950A

United States Patent [19]

Ballhausen et al.

[11] Patent Number: 5,457,950

[45] Date of Patent: Oct. 17, 1995

[54] SPINDLE FOR MANUFACTURING A YARN

[75] Inventors: Ulrich Ballhausen, Aachen; Karl J. Brockmanns, Willich-Anrath; Ulrich Lossa, Krefeld, all of Germany

[73] Assignee: Palitex Project-Company GmbH, Krefeld, Germany

[21] Appl. No.: 212,499

[22] Filed: Mar. 11, 1994

[30] Foreign Application Priority Data

Mar. 13, 1993 [DE] Germany ..... 43 08 024.3

[51] Int. Cl.[6] ..... D01H 1/42; D01H 7/18

[52] U.S. Cl. ..... 57/308; 57/58.36; 57/58.38; 57/58.83; 57/296; 57/309; 57/352; 57/354

[58] Field of Search ..... 57/295, 296, 308, 57/309, 58.36, 38.38, 58.49, 58.83, 352, 354, 279

[56] References Cited

U.S. PATENT DOCUMENTS

| | | | |
|---|---|---|---|
| 3,159,962 | 12/1964 | Franzen | 57/296 |
| 3,429,113 | 2/1969 | Numtz et al. | 57/296 |
| 4,055,937 | 11/1977 | Latus et al. | 57/354 |
| 4,120,142 | 10/1978 | Franzen | 57/352 |
| 4,328,663 | 5/1982 | Kallmann | 57/58.49 |

FOREIGN PATENT DOCUMENTS

| | | | |
|---|---|---|---|
| 2811583 | 2/1979 | Germany | 57/308 |
| 3721364 | 1/1989 | Germany . | |

*Primary Examiner*—Daniel P. Stodola
*Assistant Examiner*—William Stryjewski
*Attorney, Agent, or Firm*—Robert W. Becker & Associates

[57] ABSTRACT

A spindle for manufacturing a yarn has a spindle body for receiving a fiber supply bobbin from which a fiber is removed radially outwardly to form a fiber balloon and guided to a centering point above the spindle body. A spindle rotor for rotating the spindle body has a central axis. A supply device for introducing a flowable medium into the space limited by the fiber balloon is provided. The supply device has an inlet line with an outlet opening. The inlet line has a section adjacent to the outlet opening extending at least directly upstream of the outlet opening coaxially or parallel to the central axis. At least a portion of the section is rotatable about the central axis and has a fiber guide tube comprising a first end that extends coaxially from the portion and a second end that extends radially from this portion.

13 Claims, 5 Drawing Sheets

SPINDLE FOR MANUFACTURING A YARN

BACKGROUND OF THE INVENTION

The present invention relates to a spindle for manufacturing a yarn or twisted thread with a spindle rotor that has a radially outwardly oriented yarn guide channel for a yarn which channel starts substantially in the area of the spindle axis. The fiber or yarn after exiting from the yarn guide channel forms a balloon and is guided to a centering point positioned at an extension of the spindle rotor axis. The spindle further has a device for introducing a flowable medium substantially in the axial direction into the space defined by the balloon.

Such a spindle is known from German patent 37 61 364.

In the known spindle the solution to the problem of introducing a flowable medium into the space delimited by the yarn balloon in a disturbance-free manner is solved by providing the spindle rotor with a plurality of guide vanes that are arranged in a spoke-type arrangement whereby the yarn guide channel extends through one of the guide vanes. The flowable material is introduced into a housing which is open and has radial symmetry and is positioned between the spindle rail and the spindle rotor. From the housing the medium flows between the guide vanes of the spindle rotor and through the perforated bottom of the protective pot into the interior of the protective pot. This housing requires a considerable amount of space and increases, due to its arrangement between the spindle rail and the spindle rotor, the constructive height of the spindle. Furthermore, the guide vanes of the spindle rotor have proven to be an obstacle for the free flow especially of solid particles. In addition, due to the ventilation effect, surrounding air is conveyed through the spindle rotor which results in soiling of the guide vanes, a further undesirable effect with respect to introducing the medium.

It is therefore an object of the present invention to provide a spindle of the aforementioned kind with which the device for introducing the flowable medium in the axial direction into the space delimited by the yarn balloon requires less space, especially with respect to the constructive height of the spindle and which ensures an unobserved introduction of the medium.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
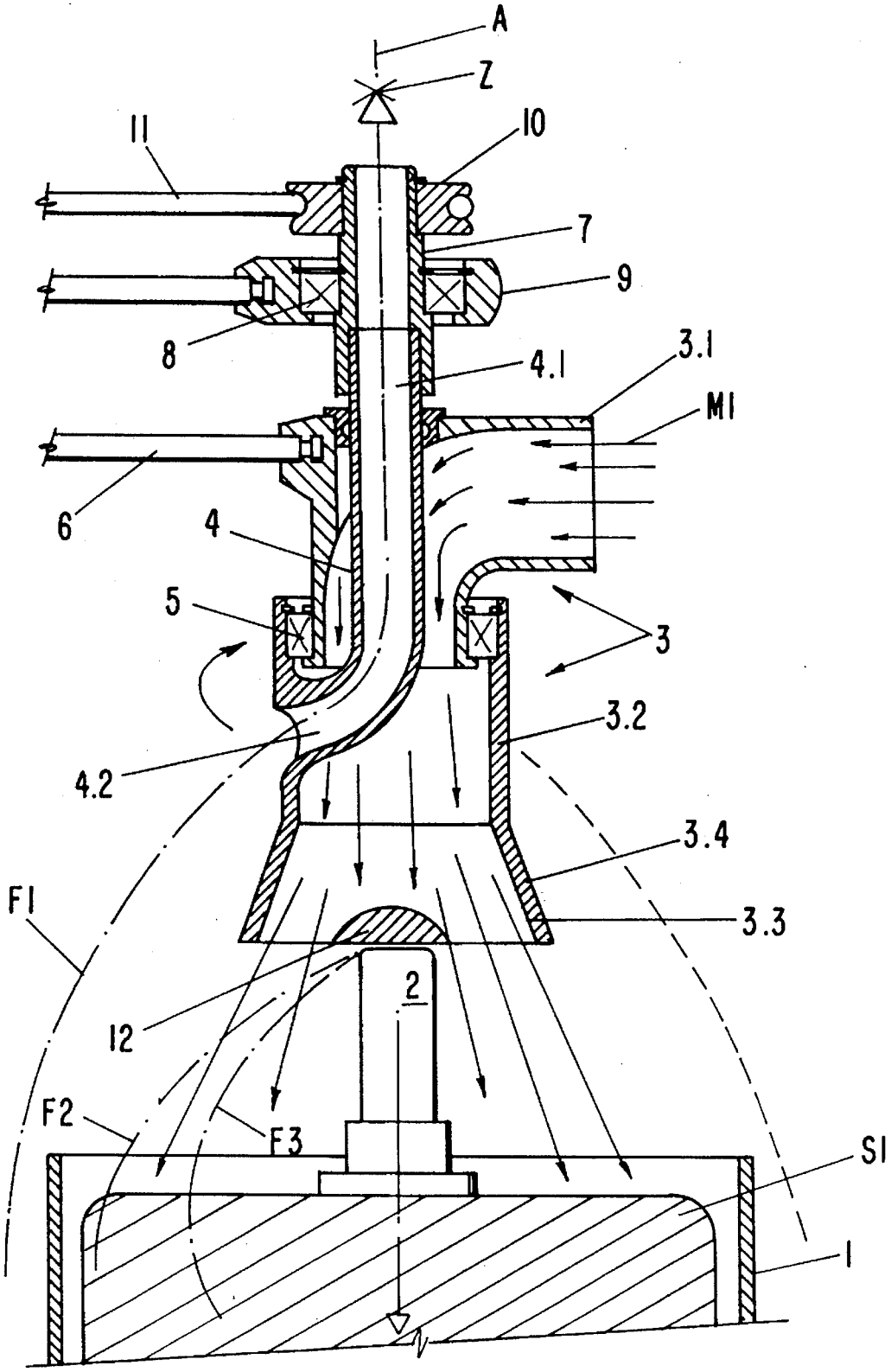
FIG. 1 shows a partially sectioned side view of the upper part of a two-for-one twisting spindle with a device for axially introducing a flowable medium from the top.
Figure 2:
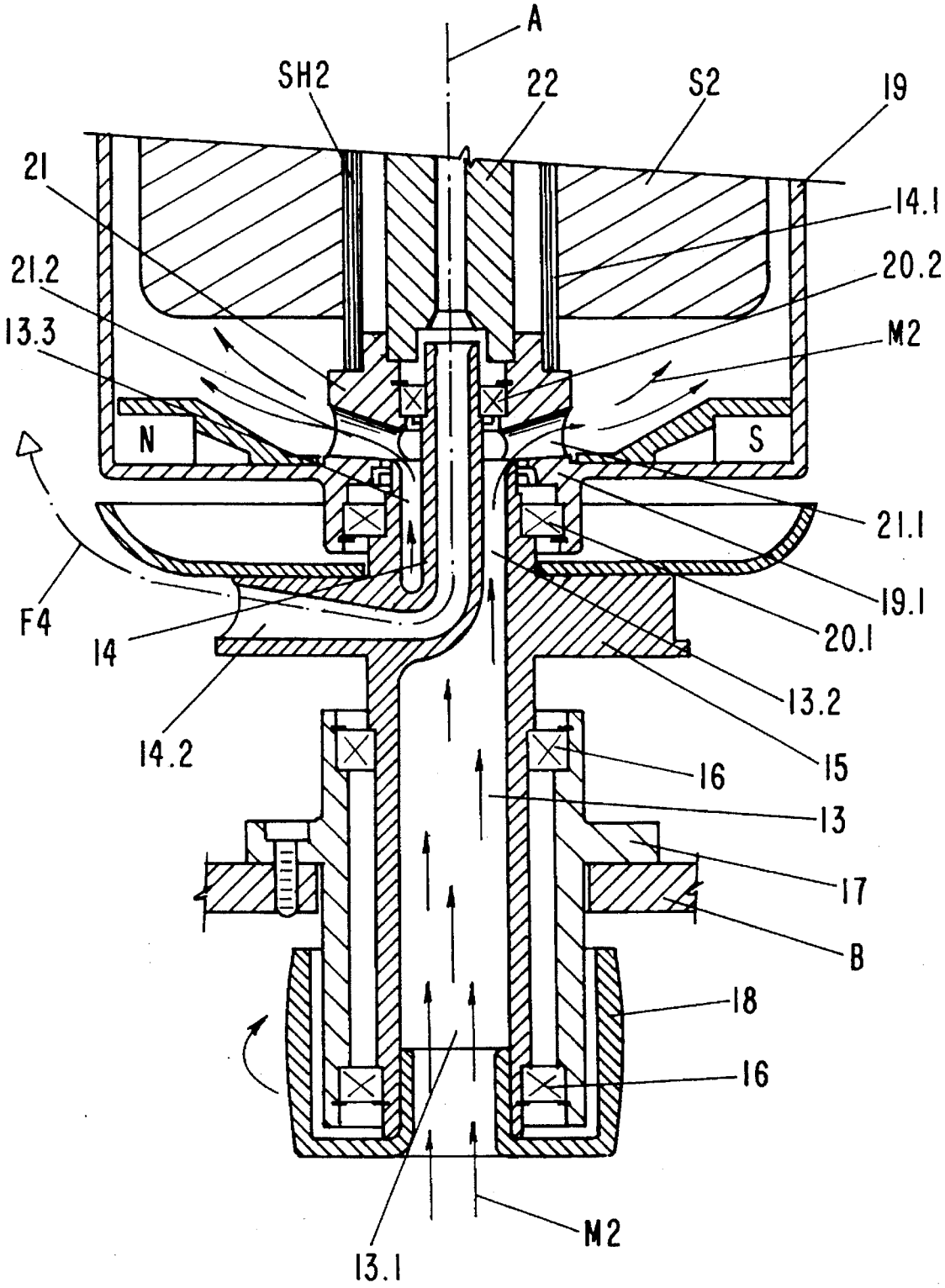
FIG. 2 shows an axial section of the lower portion of a two-for-one twisting spindle with a first embodiment of the device for introducing a flowable medium in the axial direction from the bottom.

A spindle for manufacturing a yarn according to the present invention is primarily characterized by:

A spindle body for receiving a yarn supply bobbin from which a yarn is removed radially outwardly to form a yarn balloon and guided to a centering point above the spindle body;

A spindle rotor for rotating the spindle body, the spindle rotor having a central axis;

A supply device for introducing a flowable medium into a space limited by the yarn balloon;

The supply device having an inlet line with an outlet opening, the inlet line having a line section adjacent to the outlet opening extending at least directly upstream of the outlet opening coaxially to the central axis; and Wherein at least a portion of the line section is rotatable about the central axis and has a yarn guide comprising a first end that extends coaxially from that portion and a second end that extends radially from that portion of the line section.

Advantageously, the inlet line is positioned above the spindle body. The first end of the yarn guide tube extends preferably coaxially toward the centering point. The second end receives the yarn removed from the yarn balloon.

Advantageously, the spindle further comprises a drive unit for driving the portion of the line section.

Expediently, the outlet opening widens in a funnel shape.

In a preferred embodiment of the present invention, the spindle is a two-for-one twister comprising a yarn feed duct with an inlet in the spindle body, further comprising a cover positioned between the outlet opening and the inlet of the yarn feed duct.

Advantageously, the inlet line is positioned under the spindle body and extends through the spindle rotor, wherein the first end of the yarn guide tube extends coaxially to the central axis and the second end extends radially outwardly for guiding the yarn radially outwardly during removal from the supply bobbin.

In another embodiment, the spindle is a two-for-one twister and the spindle body comprises a bottom, a hollow spindle shaft, and a distributor member, the distributor member fixedly connected to the bottom and the hollow spindle shaft connected to the distributor member. The distributor member has substantially radial outlets. The inlet line extends coaxially through the spindle rotor, with the outlet opening located in the bottom and communicating with the radial outlets of the distributor member. The first end of the yarn guide tube is rotatably connected within the distributor member and extends into the inlet line.

In a further embodiment of the present invention, the spindle is a two-for-one twister. The spindle body has a spool carrier with a bottom and a cover. The inlet line extends coaxially through the spindle rotor. The line section of the inlet line and the first end of the yarn guide tube are connected in a rotatable manner within the bottom of the bobbin carrier, wherein the outlet opening opens in the axial direction. The supply bobbin is preferably suspended from the cover of the bobbin carrier, wherein a yarn removed from the supply bobbin is directly introduced into the first end of the yarn guide tube.

In yet another embodiment of the present invention for a two-for-one twister, the spindle body has a bobbin carrier with a bottom and a hollow spindle shaft, the bobbin carrier having a radial holder with a through opening for the yarn removed from the supply bobbin. The radial holder supports the hollow spindle shaft. The inlet line extends coaxially through the spindle rotor. The line section of the inlet line is connected in a rotatable manner within the bottom of the bobbin carrier, whereby the outlet opening opens axially. The second end of the yarn guide tube opens into the line section of the inlet line such that the line section of the inlet line also serves as the first end of the yarn guide tube.

In a second embodiment of the present invention, the spindle for manufacturing a yarn is primarily characterized by:

A spindle body for receiving a fiber supply bobbin from which a yarn is removed radially outwardly to form a yarn balloon and guided to a centering point above the spindle body. A spindle rotor for rotating the spindle body is provided whereby the spindle rotor has a central axis. A supply device for introducing a flowable medium into a space limited by the yarn balloon is provided. The supply device has an inlet line with an outlet opening, the inlet line having a line section adjacent to the outlet opening extending at least directly upstream of the outlet opening parallel to the central axis. At least a portion of the line section is rotatable about the central axis and has a yarn guide tube comprising a first end that extends coaxially to the central axis and a second end that extends radially from the portion.

Advantageously, the inlet line is positioned under the spindle body and extends through the spindle rotor wherein the first end of the yarn guide tube extends coaxially to the central axis and the second end extends radially outwardly for guiding the yarn radially outwardly during removal from the supply bobbin.

Expediently, the spindle is a two-for-one twister with a spindle body comprising a hollow spindle shaft with a base, a bobbin carrier, an arresting device, and a rotary bearing. The spindle rotor has a head portion extending into the spindle body. The base of the hollow spindle shaft is supported with a rotary bearing on the head portion of the spindle rotor, wherein the base of the hollow spindle shaft is arrested with the arresting device relative to the bobbin carrier. The inlet line extends through the spindle rotor and the section of the inlet line extends eccentrically to the center axis within the head portion. The outlet opening of the inlet line opens substantially radially within the head portion.

The introduction of a flowable medium in the axial direction into the space delimited by the yarn balloon is in general possible from two directions, i.e., from the top or the bottom. The inventive solution encompasses both possibilities. For an introduction from the bottom the medium is guided through the axis of the spindle rotor which is advantageous since the introduction of the medium from a point below the spindle rail is thus possible so that with this embodiment the constructive height of the spindle above the spindle rail is not substantially increased. When the medium is introduced from the top, the spindle itself and its support must not be changed so that this embodiment is, for example, especially suitable for retrofitting already existing devices.

The flowable medium, for example, may be a treatment medium such as conditioned air, but also multi-phase media such as air containing suspended droplets of a suitable liquid, suspended solid particles, or dissolved fiber material that is designed to provide special effects on the yarn.

DESCRIPTION OF PREFERRED EMBODIMENTS

The present invention will now be described in detail with the aid of several specific embodiments utilizing FIGS. 1 through 5.

FIG. 1 shows only the components of a two-for-one twisting spindle that are necessary for the following explanations, i.e., the bobbin carrier with protective pot 1 in which a non-twisted yarn fiber supply is provided (in FIG. 1 in a form of a bobbin S1. The yarns F2 and F3 removed from the supply bobbin are introduced via the yarn feed tube 2 and the non-represented hollow spindle shaft into the also not-represented spindle rotor from where the twisted fiber or yarn F1 exits in the radial direction through a non-represented yarn guide channel outwardly and forms a yarn balloon while being guided in the upward direction towards a centering point Z.

Above the twisting spindle a device for introducing a flowable medium M1 is arranged. This supply device is provided with a line that is indicated in general with reference numeral 3. Through the line 3 the medium M1 is introduced and deflected in the axial direction downwardly. The line 3 is comprised of a first pipe knee 3.1 which is connected with a holder 6 to a non-represented frame of the twisting machine. Adjacent to the first line section 3.1 in the downward direction a second line section 3.2 is provided which is connected to the first line section 3.1 with a rotary bearing 5 so as to be rotatable about the spindle axis and rotor axis A. The second line section 3.2 at its lower end is provided with a funnel-shaped widened portion 3.4 having a downwardly extending outlet opening 3.3. Within the second line section 3.2 a yarn guide tube 4 is arranged having a lower end 4.2 that is guided laterally outwardly in the radial direction away from the second line section 3.2, while the upper end 4.1 extends coaxially to the spindle axis (rotor axis) A in the upward direction away from the rotatable line section 3.2 and extends through the fixedly connected line section 3.1 from which it emerges in the upward direction. The upper end 4.1 of the yarn guide tube 4 is fixedly connected to an extension 7 which is supported with a rotary bearing 8 in a holder 9 that is fixedly connected to the non-represented frame of the twisting machine. At the upper end of the extension 7 a drive roller 10 is provided about which a drive belt 11 is guided. With the drive belt 11 the drive roller 10 can be rotated about the spindle axis (rotor axis) A with a non-represented drive device that is in a fixed or open rotational connection with the drive of the spindle rotor.

During operation the yarn F1 exiting from the yarn balloon is introduced into the lower end 4.2 of the yarn guide tube 4 and exits from the upper end 4.1 in the direction toward the centering point Z.

Via the drive roller 10 the yarn guide tube 4 and with it the lower section 3.2 of the line 3 is rotated at a speed which corresponds to the circumferential speed of the yarn F1 within the yarn balloon and thus to the rotational speed of the spindle rotor. The flowable medium M1 introduced into the line section 3.1 exits within the lower line section 3.2 into the interior of the yarn balloon and is guided through the outlet opening 3.3 into the interior of the protective pot 1. Above the inlet opening of the yarn feed tube 2 a cover 12 is provided which prevents that the medium is directly introduced into the yarn feed tube 2.

In FIG. 2 again only the components of a two-for-one twisting spindle of a twisting machine are described which are necessary for the following description of the invention.

The two-for-one twisting spindle has a spindle rotor 15 which is connected with a rotary bearing 16 on a sleeve 17. The sleeve 17 is inserted into an opening of the spindle rail B and is fixedly connected thereto. The drive of the spindle rotor 15 is effected by a whorl 18 positioned below the spindle rail B with non-represented drive belts. Above the spindle rotor 15 a bobbin carrier with a protective pot 19 is arranged in which a supply bobbin S2 with non-twisted yarn is connected and which is connected with the spindle rotor 15 via a rotary bearing 20.1.

A line 13 extends over the entire length of the spindle rotor 15 coaxially to the spindle rotor axis A with a flowable medium M2 being introduced into the lower section of the line 13 below the spindle rail B. The upper line section 13.2 of the line 13 opens into an axially oriented outlet opening 13.3 which is positioned opposite to a distributor member 21 that is fixedly connected to the bottom 19.1 of the protective pot. This distributor member 21 has radial outlets 21.1 and 21.2 for the medium M2. A yarn guide tube 14 is also guided through the spindle rotor 15 which tube 14 has a lower end 14.2 that extends radially relative to the spindle rotor 15 and forms a yarn guide channel. The upper end 14.1 of the yarn guide 14 which extends in the axial direction and is connected to the lower end 14.2 extends past the upper section 13.2 of the line 13 in the axial direction. It extends through the distributer member 21 in a rotatable manner and is connected with the distributor member 21 with a rotary bearing 20.1. The upper end 14.1 of the yarn guide tube 14 is coaxial to the hollow spindle shaft 22. The bobbin sleeve SH2 of the supply bobbin S2 is supported on the distributor member 21.

During operation a yarn is removed from the supply bobbin S2 and is guided through the yarn feed tube and the hollow spindle shaft 22 in a downward direction. This is not represented in the drawing. The yarn first passes through the upper portion 14.1 of the yarn guide tube 14 and then exits in the radial direction from the yarn guide channel 14.2 where the yarn F4 then forms the yarn balloon in a non-represented manner and is upwardly guided to the non-represented centering point Z.

The medium M2 is introduced from the bottom of the spindle rail B into the lower end 13.1 of the line 13 and exits within the upper line section 13.2 into the area within the yarn balloon and through the exit openings 21.1 and 21.2 of the distributor member into the space within the bobbin carrier with protective pot 19.

Figure 3:
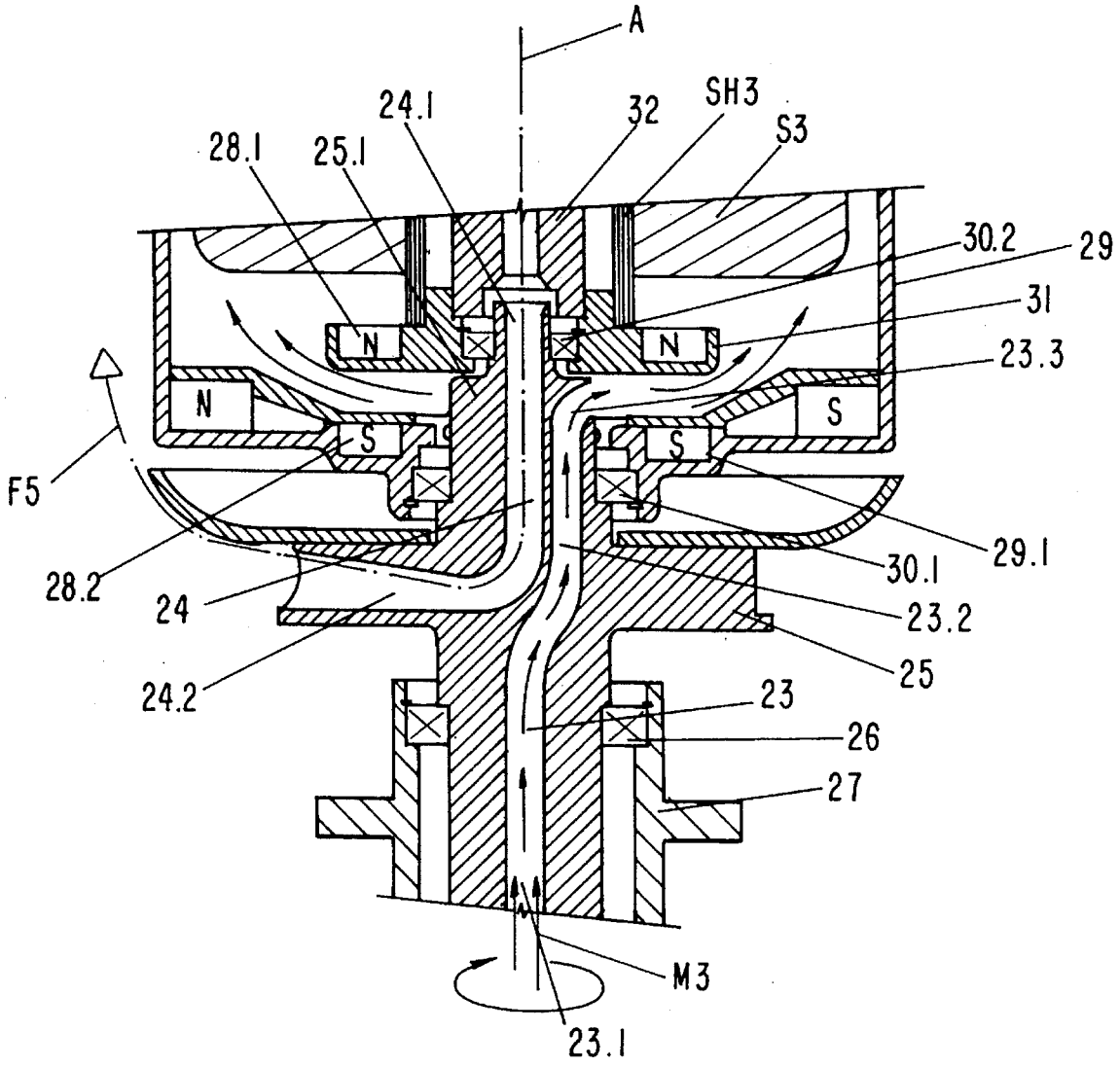
FIG. 3 shows in a representation in analogy to FIG. 2 a second embodiment of a device for introducing a flowable medium in the axial direction from the bottom.

The embodiment represented in FIG. 3 has a spindle rotor 25 which is connected with a rotary bearing 26 with sleeve 27 that is connected to the non-represented spindle rail.

A line 23 extends through the spindle rotor 25 which with its lower line section 23.1 is coaxial and with its upper line section 23.2 parallel to the spindle rotor axis A. In this embodiment the upper end of the spindle rotor together with the line section 23.2 is introduced into the interior of the protective pot 29 in which the upper line section 23.2 opens in the form of a substantially radially positioned outlet opening 23.3. The spindle rotor 25 is connected with a rotary bearing 30.1 to the bottom 29.1 of the bobbin carrier with protective pot 29. Furthermore, a yarn guide tube 24 extends through the spindle rotor 25 and has a lower end 24.2 that forms the yarn guide channel. To the lower end 24.2 the coaxially extending upper end 24.1 of the yarn guide tube 24 is connected which extends thus parallel to the upper line section 23.2 which in this area extends eccentrically. This upper end extends through a head piece 25.1 of the spindle rotor 25 on which the base 31 is supported with a rotary bearing 30.2. The base 31 supports the hollow spindle shaft 32 to which the sleeve SH3 of the bobbin S3 is attached. In this embodiment the hollow spindle shaft 32 is thus not fixedly connected to the protective pot 29. Arresting of the base 31 relative to the protective pot bottom 29.1 is achieved with oppositely arranged permanent magnets 28.1 and 28.2. During operation the yarn coming from the supply bobbin S3 runs through the hollow spindle shaft 32 and enters the upper end 24.1 of the yarn guide channel 24. The yarn F5 exits from the yarn guide channel 24.2 and forms the yarn balloon.

The flowable medium M3 is introduced below the spindle rail into the lower line section 23.1 of the line 23 and enters within the upper line section 23.2 into the space delimited by the yarn balloon and is introduced through the exit opening 23.3 into the interior of the bobbin carrier with protective pot 29.

Figure 4:
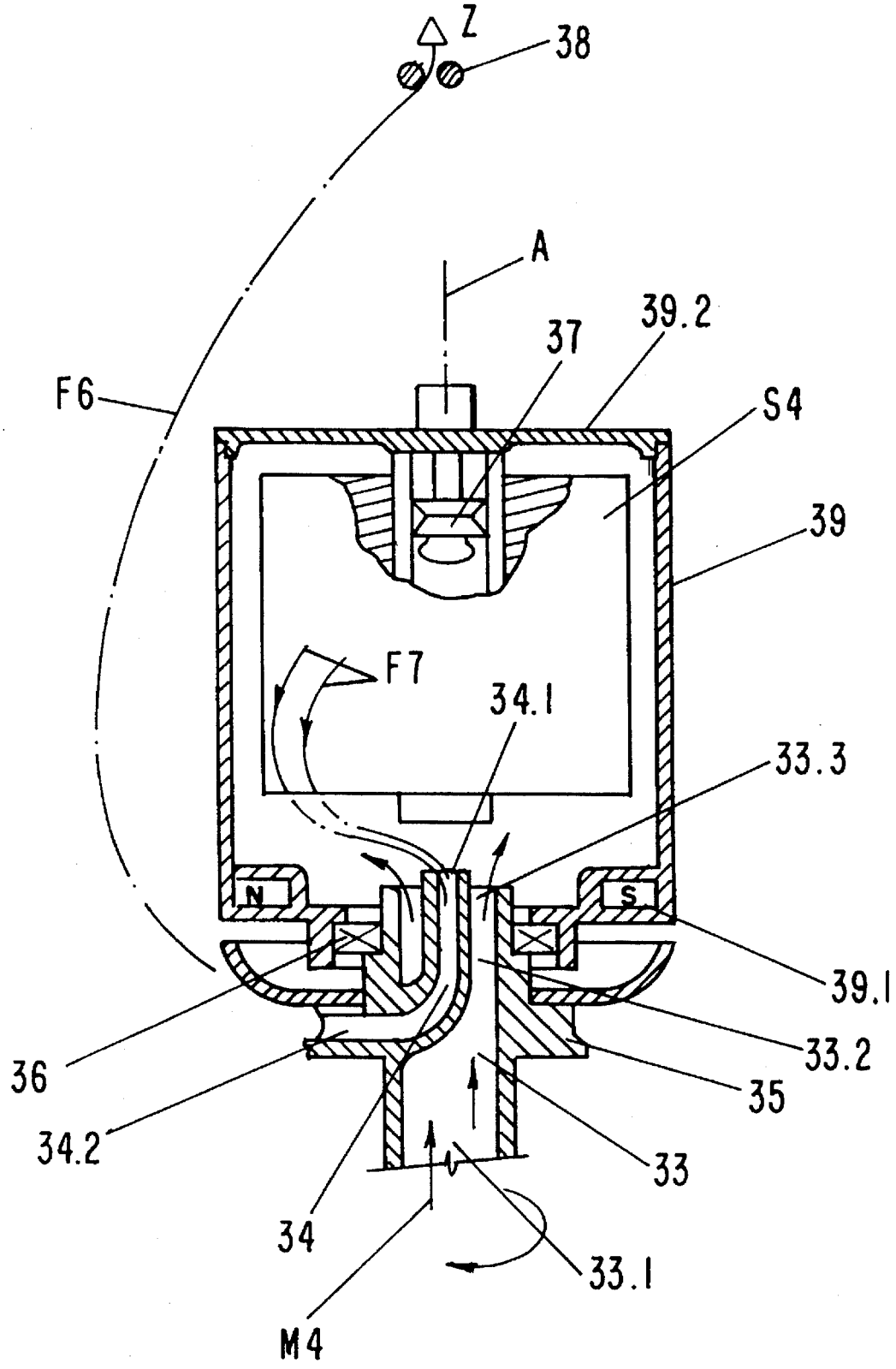
FIGS. 4 and 5 show in respectively partially sectioned side views two-for-one twisting spindles with two further embodiments for a device for introducing a flowable medium in the axial direction from the bottom.
Figure 5:
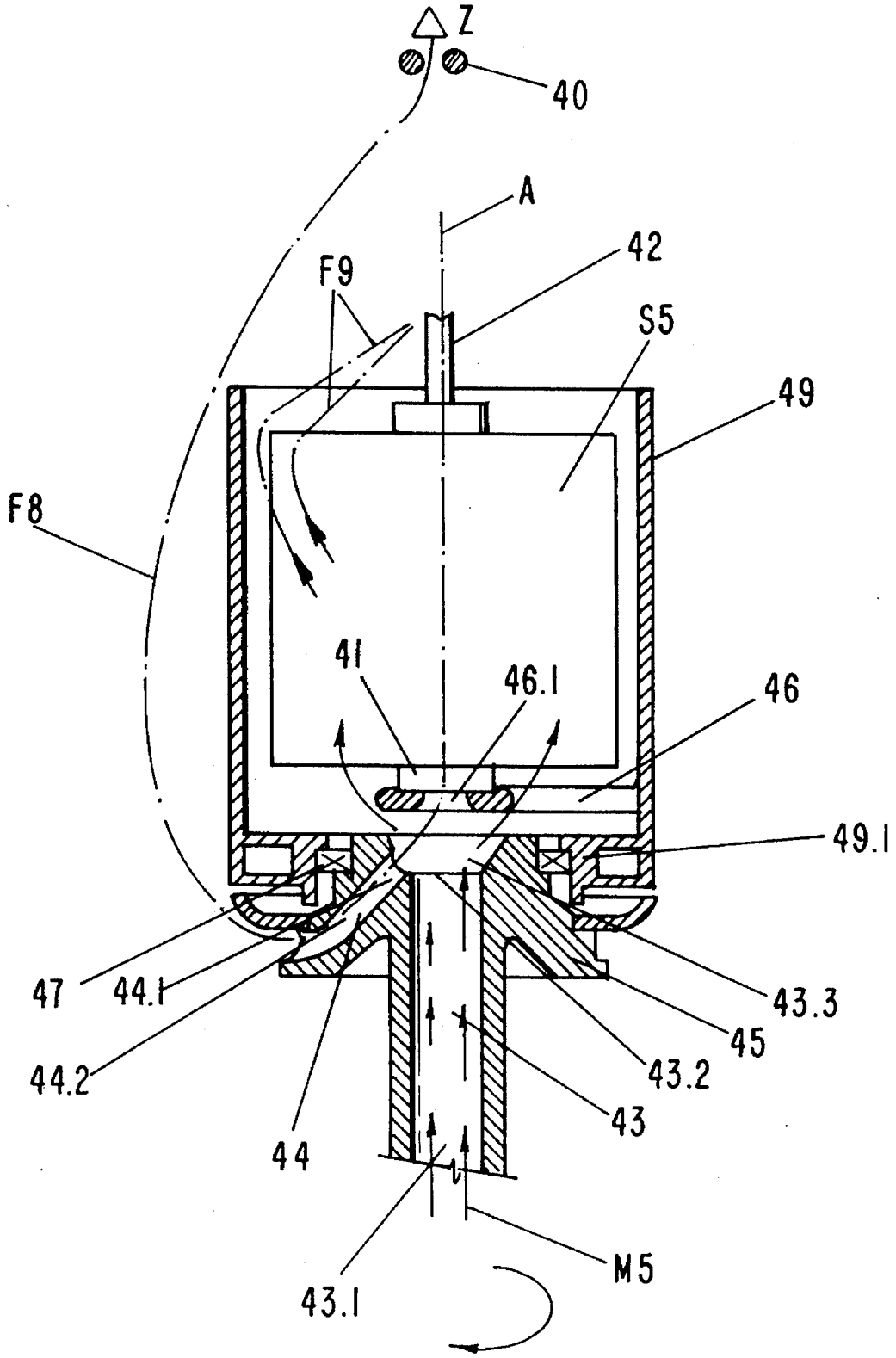

In FIGS. 4 and 5 two further embodiments of devices for axially introducing a flowable medium from the bottom into a two-for-one twisting spindle are represented.

In the embodiment according to FIG. 4 the introduction of the flowable medium M4 takes place via the line 33 which extends coaxially over the entire length of the spindle rotor 35 and has a lower line section 33.1 into which the medium M4 is introduced from a point below the spindle rail. Via the upper line section 33.2 that extends with a rotary bearing 36 through the bottom 39.1 of the bobbin carrier with protective pot 39 the medium is guided into the interior of the bobbin carrier with protective pot 39. The upper end 34.1 of the yarn guide tube 34 extends coaxially to the axis of the spindle rotor A while the lower end of the yarn guide tube 32 forms the radially extending yarn guide channel 34.2 from which the yarn F6 exits and via the yarn balloon is guided to the centering point Z which is embodied by the yarn guide eyelet 38.

The supply bobbin S4 in this embodiment is connected to the cover 39.2 of the bobbin carrier with protective pot 39 with a suspending device 37.

During operation the yarns F7 are guided from the supply bobbin S4 through the yarn guide tube 34, while the medium M4 which is introduced in the axial direction from the bottom exits from the outlet opening 33.3 of the line 33 and is thus introduced directly into the interior of the bobbin carrier with protective pot 39.

In the embodiment of FIG. 5 the flowable medium M5 is introduced in the radial direction from the bottom via a coaxially extending line 43 through the spindle rotor 45. The spindle rotor 45 extends with a rotary bearing 47 through the bottom 49.1 of the bobbin carrier with protective pot 49 so that the medium M5 can enter through the outlet opening 43.3 within the upper line section 43.2 into the interior of the bobbin carrier with protective pot 49. The yarn guide tube 44 with its lower section forms the radial extending yarn guide channel 44.2 which opens into the upper line section 43.2 so that the upper end 44.1 of the yarn guide tube 44 is also coaxially oriented relative to the spindle axis A. The hollow spindle shaft 41 is supported in this embodiment on a support 46 which is radially connected to the bobbin carrier with protective pot 49 and has a through opening 46.1 for the yarn arranged at the spindle axis A. During operation the yarns F9 are removed from the bobbin supply S5 and guided through the yarn guide tube 42 and the hollow spindle shaft from where they are introduced through the yarn through opening 46.1 into the yarn guide tube 44. The yarn F8 exits the yarn guide tube 44 through the yarn guide channel 44.2 and after passing through the yarn balloon is guided to the yarn guide eyelet 40 that represents the centering point Z.

The inventive spindle is also suitable for two-for-one twisting spindles without a protective pot.

The present invention is, of course, in no way restricted to the specific disclosure of the specification and drawings, but also encompasses any modifications within the scope of the appended claims.

What we claim is:

1. A spindle for manufacturing a yarn, said spindle comprising:

a spindle body for receiving a supply bobbin from which a yarn is removed radially outwardly to form a yarn balloon and guided to a centering point above said spindle body;

a spindle rotor for rotating said spindle body, said spindle rotor having a central axis;

a supply device for introducing a flowable medium into a space limited by the yarn balloon;

said supply device having an inlet line with an outlet opening, said inlet line having a line section adjacent to said outlet opening extending at least directly upstream of said outlet opening coaxially to said central axis;

wherein at least a portion of said line section is rotatable about said central axis and has a yarn guide tube comprising a first end that extends coaxially with said portion of said line section and a second end that extends radially from said portion of said line section; and wherein said inlet line is positioned above said spindle body.

2. A spindle according to claim 1, wherein:

said first end of said yarn guide tube extends coaxially toward said centering point; and said second end receives a yarn removed from the yarn balloon.

3. A spindle according to claim 2, further comprising a drive unit for driving said portion.

4. A spindle according to claim 1, wherein said outlet opening widens in a funnel shape.

5. A spindle according to claim 1, wherein said spindle is a two-for-one twister comprising a yarn feed duct with an inlet in said spindle body, further comprising a cover positioned between said outlet opening and said inlet of said yarn feed duct.

6. A spindle for manufacturing a yarn, said spindle comprising:

a spindle body for receiving a yarn supply bobbin from which a yarn is removed radially outwardly to form a yarn balloon and guided to a centering point above said spindle body;

a spindle rotor for rotating said spindle body, said spindle rotor having a central axis;

a supply device for introducing a flowable medium into a space limited by the yarn balloon;

said supply device having an inlet line with an outlet opening, said inlet line having a line section adjacent to said outlet opening extending at least directly upstream of said outlet opening parallel to said central axis;

wherein at least a portion of said line section is rotatable about said central axis and has a yarn guide tube comprising a first end that extends coaxially to said central axis and a second end that extends radially from said portion of said line section;

wherein said spindle body comprises a hollow spindle shaft with a base and an arresting device for arresting said base;

wherein said spindle rotor has a head portion extending into said spindle body;

wherein said inlet line extends through said spindle rotor and said line section of said inlet line extends eccentrically to said center axis within said head portion; and said outlet opening of said inlet line opens substantially radially within said head portion.

7. A spindle according to claim 6, wherein said inlet line is positioned under said spindle body and extends through said spindle rotor wherein said first end of said yarn guide tube extends coaxially to said central axis and said second end extends radially outwardly for guiding the yarn radially outwardly during removal from the supply bobbin.

8. A spindle according to claim 7, wherein:

said spindle is a two-for-one twister;

said spindle body comprises a bobbin carrier and a rotary bearing; and said base of said hollow spindle shaft is supported with said rotary bearing on said head portion of said spindle rotor, wherein said base of said hollow spindle shaft is arrested with said arresting device relative to said bobbin carrier.

9. A spindle for manufacturing a yarn, said spindle comprising:

a spindle body for receiving a supply bobbin from which a yarn is removed radially outwardly to form a yarn balloon and guided to a centering point above said spindle body;

a spindle rotor for rotating said spindle body, said spindle rotor having a central axis;

a supply device for introducing a flowable medium into a space limited by the yarn balloon;

said supply device having an inlet line with an outlet opening, said inlet line having a line section adjacent to said outlet opening extending at least directly upstream of said outlet opening coaxially to said central axis;

wherein at least a portion of said line section is rotatable about said central axis and has a yarn guide tube comprising a first end that extends coaxially with said portion of said line section and a second end that extends radially from said portion of said line section; and wherein said spindle body comprises a bottom, a hollow spindle shaft, and a distributor member, said distributor member fixedly connected to said bottom and said hollow spindle shaft connected to said distributor member, said distributor member having substantially radial outlets.

10. A spindle according to claim 9, wherein said inlet line is positioned under said spindle body and extends through said spindle rotor, wherein said first end of said yarn guide tube extends coaxially to said central axis and said second end extends radially outwardly for guiding the yarn radially outwardly during removal from the supply bobbin.

11. A spindle according to claim 10, wherein:

said spindle is a two-for-one twister;

said inlet line extends coaxially through said spindle rotor, with said outlet opening located in said bottom and communicating with said radial outlets of said distributor member; and said first end of said yarn guide tube is rotatably connected within said distributor member and extending into said inlet line.

12. A spindle according to claim 10, wherein:

said spindle is a two-for-one twister;

said spindle body has a spool carrier with a bottom and a cover;

said inlet line extends coaxially through said spindle rotor;

said line section of said inlet line and said first end of said yarn guide tube are connected in a rotatable manner within said bottom of said bobbin carrier, wherein said outlet opening opens axially; and the supply bobbin is suspended from said cover of said bobbin carrier, wherein a yarn removed from the supply bobbin is directly introduced into said first end of said yarn guide tube.

13. A spindle according to claim 10, wherein:

said spindle is a two-for-one twister;

said spindle body has a bobbin carrier with a bottom and a hollow spindle shaft, said bobbin carrier having a radial holder with a through opening for the yarn removed from the supply bobbin, said radial holder supporting said hollow spindle shaft;

said inlet line extends coaxially through said spindle rotor;

said line section of said inlet line is connected in a rotatable manner within said bottom of said bobbin carrier, wherein said outlet opening opens axially; and said second end of said yarn guide tube opens into said line section of said inlet line such that said line section of said inlet line also serves as said first end of said yarn guide tube.

* * * * *